United States Patent [19]

McLaurin et al.

[11] Patent Number: 4,891,935

[45] Date of Patent: Jan. 9, 1990

[54] FUEL NOZZLE ASSEMBLY FOR A GAS TURBINE ENGINE

[75] Inventors: Leroy D. McLaurin, Winter Springs, Fla.; David Y. K. Toy, East Brunswick, N.J.

[73] Assignee: Westinghouse Electric Corp., Pittsburgh, Pa.

[21] Appl. No.: 357,698

[22] Filed: May 26, 1989

Related U.S. Application Data

[63] Continuation of Ser. No. 111,890, Oct. 23, 1987, abandoned.

[51] Int. Cl.[4] ..... F02C 7/22

[52] U.S. Cl. ..... 60/39.37; 60/737; 60/740; 239/397.5

[58] Field of Search ..... 60/39.32, 737, 738, 60/740, 748; 239/397.5, 424.5

[56] References Cited

U.S. PATENT DOCUMENTS

| | | | |
|---|---|---|---|
| 2,140,188 | 12/1938 | Marsh . | |
| 3,911,672 | 10/1975 | Irwin | 60/39.32 |
| 4,154,056 | 5/1979 | Emory | 60/740 |
| 4,258,544 | 3/1981 | Gebhart et al. | 60/39.32 |
| 4,409,791 | 10/1983 | Jourdain et al. | 60/39.32 |
| 4,513,569 | 4/1985 | Sasaki et al. | 60/39.32 |
| 4,613,079 | 9/1986 | Mains . | |

*Primary Examiner*—Louis J. Casaregola
*Assistant Examiner*—Timothy S. Thorpe
*Attorney, Agent, or Firm*—K. Bach

[57] ABSTRACT

A fuel nozzle assembly having a fuel nozzle tip at one end of a fuel delivery tube and a supporting flange at the other end. An air delivery tube, also secured to the support flange, encloses the fuel delivery tube to define an annular air passage therebetween. An integral fuel nozzle/end cap engages the fuel and air tubes and provides passages for fuel flowing from the fuel delivery tube and air flowing from the air delivery tube. Biasing means exerts an axial force on the air delivery tube to tighten the engagement of the tubes into an air-tight fit.

16 Claims, 2 Drawing Sheets

FUEL NOZZLE ASSEMBLY FOR A GAS TURBINE ENGINE

This is a continuation of application Ser. No. 111,890, filed Oct. 23, 1987, now abandoned.

This application is related to U.S. patent application Ser. No. 111,892, now abandoned and U.S. patent application Ser. No. 111,891, now U.S. Pat. No. 4,850,196.

BACKGROUND OF THE INVENTION

1. Field of the Invention

This invention relates to a fuel nozzle assembly for a gas turbine engine, and more specifically, to such a fuel nozzle assembly for a gas turbine engine having a fuel tube and an air tube enclosing the fuel tube to define an annular air passage therebetween, the air tube being biased into a sealing engagement with the fuel delivery tube and where differential axial expansion of the air delivery tube and fuel delivery tube tightens the sealing engagement between the tubes. The fuel nozzle assembly is constructed such that the air passage is readily accessible for cleaning.

2. Description of the Prior Art

A typical fuel nozzle assembly capable of separately delivering both air and fuel to a combustion chamber generally comprises a fuel delivery tube supported from one end and having a fuel nozzle tip with a conical surface secured to the other, and an air delivery tube, also supported by the same one end, the air delivery tube enclosing the fuel delivery tube in a spaced relationship to define therebetween an annular air flow channel. A swirl cap is threaded onto the free end of the air delivery tube and tightened so that a conical opening in the swirl cap sealingly engages the conical surface of the nozzle tip. The swirl cap is further provided with a plurality of small apertures equilangularly spaced around the center of the swirl cap for directing atomizing air from the air flow channel in a direction convergent to the fuel which exits the fuel nozzle tip in an outwardly diverging conical pattern.

As the air delivered through the assembly is primarily used only at ignition of the gas turbine engine to atomize the fuel, it is important to provide an atomizing air pattern which is predictable and delivers an atomized fuel-air mixture generally adjacent to either a flame cross-over tube or a spark ignitor, or both.

The fuel nozzle tip injects fuel in an outwardly diverging, generally conical, pattern. However, during low fuel flow, fuel pressure atomization is poor and air is introduced through the swirl cap to further atomize the fuel injected by nozzle. In such a manner, the conical pattern is altered to result in a nodular or 4-spoke spray pattern. This additional atomizing air is necessary during light-off ignition to provide greater atomization of the fuel as it is introduced through the nozzle to reduce unburned fuel emissions and to obtain better distribution of the air fuel mixture to insure that it is properly delivered to the turbine to propagate the combustion process in the turbine. After light-off ignition is complete, the atomization air is cut off and fuel only is delivered through the nozzle to continue the combustion process.

To ensure that the air flow atomizes the fuel stream to the nodular spray pattern desired during atomization, the air flow is channeled through apertures having the same geometric orientation as the opening in the fuel nozzle tip through which the fuel is directed.

Conical surfaces are utilized in such prior art devices as the conical seal, once established, was thought to provide the best air-tight seal available. To make the conical seal a high quality, air-tight seal, however, it was necessary to apply a fine grinding paste to the conical nozzle tip prior to engaging the nozzle tip with the swirl cap. Further, and more seriously, the conical nozzle tip and swirl cap utilized in achieving such a sealing interface lead to the formation of gaps at the fuel nozzle/swirl cap interface during axial expansion of the air delivery tube. This causes severe deterioration in the ability of the fuel nozzle assembly to provide the desired atomized fuel spray characteristics. In addition, such gaps encourage the formation of contaminants which further deteriorate the performance of the fuel nozzle assembly. The prior art devices are also prone to the accumulation of deposits in the air delivery channel which tends to clog it and do not provide access to the air delivery channel for removing such deposits. One such prior art fuel nozzle having a conical engagement between the swirl cap and the fuel delivery tube is disclosed in U.S. Pat. No. 4,154,056 entitled "Fuel Nozzle Assembly for a Gas Turbine Engine", issued May 15, 1979 and assigned to the assignee of the present invention.

The problems identified in the prior art devices may be traced to the fact that the temperature of the fuel flowing through the fuel delivery tube is generally about 100° Fahrenheit. The temperature of the air in the space between the tubes, however, may reach 600° Fahrenheit. Such a temperature difference between the fuel tube and the air tube often causes varied axial expansion of the fuel tube and air tube, resulting in a disengagement of the conical seal between the fuel nozzle tip and the air delivery tube, thus creating the above-mentioned gap at the sealing interface between the two. This gap provides an area where contaminants from the air flowing therethrough or carbon deposits caused by occasional reverse flow from the combustor, can accumulate to prevent the gap from resealing. The air tube itself may also become clogged with contaminants. During shutdowns, the conical seal interface may be contaminated by fuel oil from the nozzle tip.

As such, any gap between the air tube and the fuel nozzle tip provides an air leakage path that deleteriously affects the atomizing air distribution such that an unpredictable fuel-air pattern can exist which produces erratic and unpredictable light-off characteristics. If contamination of the air passage is severe enough, the flow of atomizing air may be completely cut off, preventing light-offs.

Further, once the fuel nozzle assembly of the known prior art is assembled and mounted in a combustion chamber of a gas turbine engine, it becomes extremely difficult to mechanically clean the air delivery channel and remove the contaminants which may be causing either leakage at the sealing interface or blockage of the air delivery pipe.

SUMMARY OF THE INVENTION

It is an object of this invention to provide a fuel nozzle assembly for a gas turbine engine which maintains a constant sealing interface without gapping between the fuel delivery tube and the air delivery tube during axial expansion of the air delivery tube.

Another object of this invention is to provide an integral fuel nozzle tip/end cap for a fuel nozzle assembly where the sealing interface between the air delivery tube and fuel delivery tube is remote from the fuel atomization point such that the effect of air leakage at the sealing interface on fuel atomization is minimized.

Yet another object of this invention is to provide a fuel nozzle assembly where the air delivery tube/fuel delivery tube sealing interface is improved by becoming even more air-tight during axial expansion of the air delivery tube.

Still yet another object of this invention is to provide a fuel nozzle assembly where the seal between the air delivery tube and the support flange sealing is tightened during axial expansion of the air delivery tube.

Another object of this invention is to provide a fuel nozzle assembly where at least part of the axial expansion of the air delivery tube is absorbed by the fuel nozzle assembly without detrimental effect on the operation of the fuel nozzle.

Yet another object of this invention is to provide a fuel nozzle assembly wherein the fuel delivery tube/air delivery tube interface is unlikely to accumulate carbon deposits during axial expansion of the air delivery tube.

Still yet another object of this invention is to provide a fuel nozzle assembly for a gas turbine engine or the like, wherein contamination of the air delivery tube is minimized.

Another object of this invention is to provide an air-tight sealing interface between the fuel delivery tube and the air delivery tube without applying grinding pastes to the nozzle tip.

Yet another object of this invention is to provide a fuel nozzle assembly in which the air delivery tube is readily detachable from the assembly so that the air channel is accessible for cleaning.

These and other objects and advantages are achieved by the present invention which provides a fuel nozzle assembly for a gas turbine engine. The nozzle assembly is comprised of a fuel delivery tube substantially enclosed by an air delivery tube. The fuel delivery tube has an integral fuel nozzle/end cap attached to its discharge end. The air delivery tube substantially encloses the fuel delivery tube to define an air passage between the fuel delivery tube and the air delivery tube. The integral fuel nozzle/end cap includes a central opening through which the fuel delivery tube discharges fuel, small apertures for the passage of atomizing air which are aligned with the annular air passage of the nozzle assembly such that air flowing through the air delivery tube will flow through the apertures and atomize the fuel exiting the fuel delivery tube and a lip for proper alignment of the end cap with the air delivery tube.

A support flange is provided for mounting the fuel delivery tube on a gas turbine engine. The support flange has an opening which receives a biasing- spring. The biasing force of the spring forces the air delivery tube in a tight fit against the integral fuel nozzle/end cap of the fuel delivery tube. During thermal expansion of the air delivery tube, the air delivery tube expands along its axis partly against the end cap to further tighten the fit between the two and partly against the biasing spring which absorbs the expansion force. Expansion of the air delivery tube also tightens the fit between the air delivery tube and the support flange. As varied axial expansion of the air tube and fuel tube caused by an extreme temperature difference between air flowing through the air tube and fuel flowing through the fuel tube is either absorbed by the spring or utilized to tighten the seal between the air tube and the fuel tube, the tight seal between the air tube and the fuel tube is maintained and the phenomena of gapping at the fuel tube/air tube interface observed in the prior art does not occur.

To provide a nozzle assembly in which the atomizing air passage is readily accessible for cleaning and in which the fuel tube and air tube are secured together, the air delivery tube is biased by spring force into a secure, aligned fit with the integral fuel nozzle/end cap of the air delivery tube. The integral fuel nozzle/end cap, which is screwed onto the fuel delivery tube, may be easily detached from the fuel delivery tube to release the air delivery tube and permit ready access to the annular air passage for cleaning.

BRIEF DESCRIPTION OF THE DRAWINGS

The invention may be better understood and further advantages and uses thereof are readily apparent, when considered in view of the following detailed description of exemplary embodiments, taken with the accompanying drawing in which.

DESCRIPTION OF THE PREFERRED EMBODIMENT

Figure 1B:
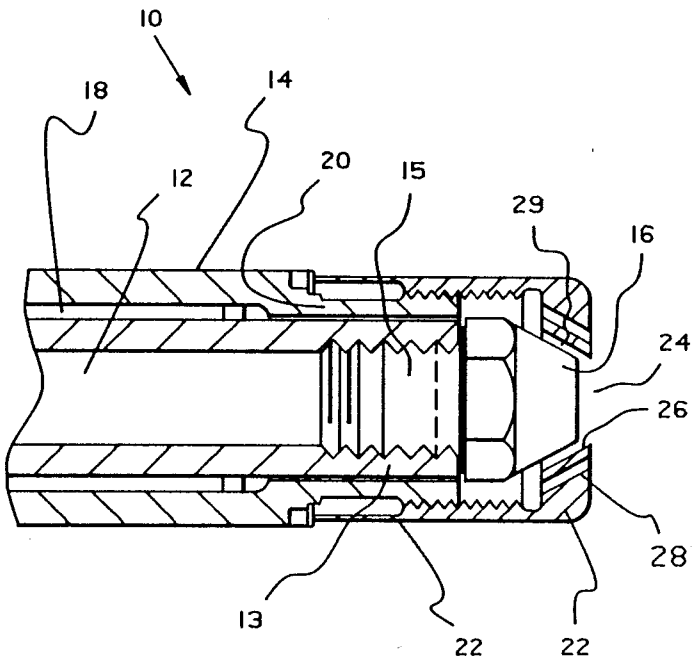
FIG. 1b. PRIOR ART
FIG. 1*b* is an axial cross-sectional view similar to FIG. 1*a* of the delivery end of the prior art fuel nozzle assembly which has undergone axial expansion caused by severe high temperature operating conditions.
Figure 1A:
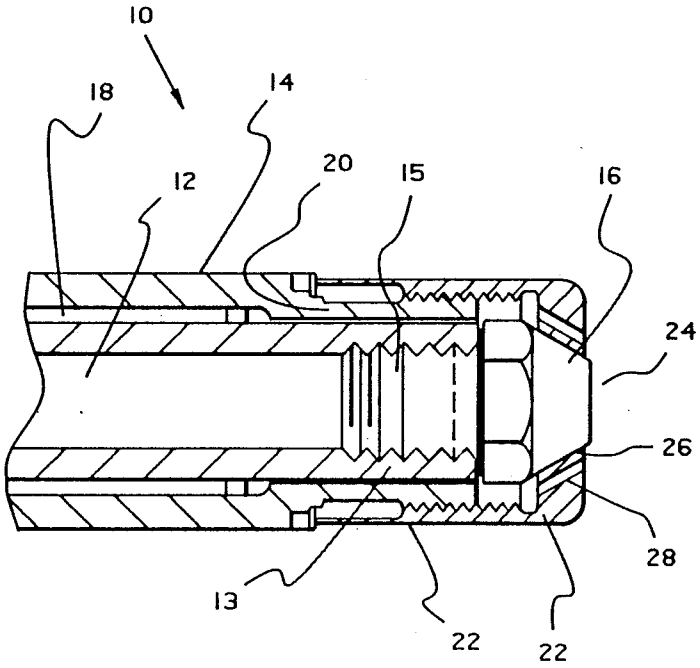
FIG. 1a. PRIOR ART
FIG. 1*a* is an axial cross-sectional view of the delivery end of a typical prior art fuel nozzle assembly under normal operating conditions.

Referring first to FIGS. 1*a* and 1*b*, the end of the nozzle assembly 10 of a typical prior art fuel nozzle assembly is shown. The nozzle assembly 10 includes an inner fuel delivery tube 12 and a surrounding outer air delivery tube 14. The air delivery tube 14 is concentric and substantially coextensive with the fuel delivery tube 12. The fuel delivery tube 12 has a delivery end 13 which includes an axial opening in which a fuel nozzle tip 15 is threaded onto the fuel delivery tube 12. The fuel nozzle tip 15 includes a conical face 16 for engaging the air delivery tube 14. The air delivery tube 14 extends axially with, and concentric to, the fuel delivery tube 12 to define an annular air passage 18 between the outer wall of fuel delivery tube 12 and the inner wall of air delivery tube 14 throughout their common axial extent. The end 20 of air delivery tube 14 has a reduced outer diameter threaded for receipt of a swirl cap 22.

The swirl cap 22 includes a centrally located opening 24. The central opening 24 is shaped to define a tapered conical surface 26. The swirl cap further includes small apertures 28 equilangularly spaced around the swirl cap 22 for directing atomizing air in a predetermined convergent direction to intercept and atomize the fuel exiting fuel nozzle tip 15. The tapered conical surface 26 is sized to conform to the taper of the conical face 16 of fuel nozzle tip 15 so that as swirl cap 22 is tightened onto air delivery tube 14, the nozzle tip 15 projects into the opening 24 and, when properly tightened, provides a sealed engagement between the conical face 16 and surface 26. FIG. 1*a* shows the nozzle assembly 10 of the prior art when subjected to normal temperature conditions, i.e. when there is no extreme temperature differential between the fuel flowing in the fuel delivery tube 12 and the air flowing in the air delivery tube 14. As clearly shown in FIG. 1*a*, when there is no temperature differential between the tubes, the fuel and air delivery tubes are sealed at the nozzle tip 15/conical surface 26 interface. No gapping is present at the interface, and contamination of the air passage 18 is unlikely. The air atomization of the fuel spray generally results in the desired atomized nodular spray pattern.

Turning to FIG. 1b, the fuel nozzle assembly 10 is shown when subject to axial expansion of the air delivery tube cause by the extreme thermal conditions during operation. During normal engine operation, combustion air from the compressor surrounds the air delivery tube 14 and has a temperature of approximately 600° to 700° F. The fuel, however, generally has a temperature of about 100° F., holding the fuel delivery tube 12 to a much lower temperature than that of the air delivery tube 14. This causes the air delivery tube to axially expand to a greater extent than the axial expansion of the fuel tube, and results in a gap 29 between the conical tip 16 and the inner surface 26. Typically, the gap 29 between the conical tip 16 and the inner surface 26 may extend as much as 0.030 inches. Because of contaminants in the air flow or the occasional reverse flow of combustion products into this gap, particles build up or become lodged in gap 29, which buildup prevents the gap from closing when the extreme temperature differential of the tubes is removed following completion of the turbine ignition. Thus, prior to a subsequent ignition of the turbine, the gap would already be present even without a temperature differential between the tubes. The air leakage through this gap deleteriously alters the discharge of the atomizing air flow, changing the atomization spray pattern of the fuel nozzle assembly and thereby altering the light-off response of the combustor.

Figure 2:
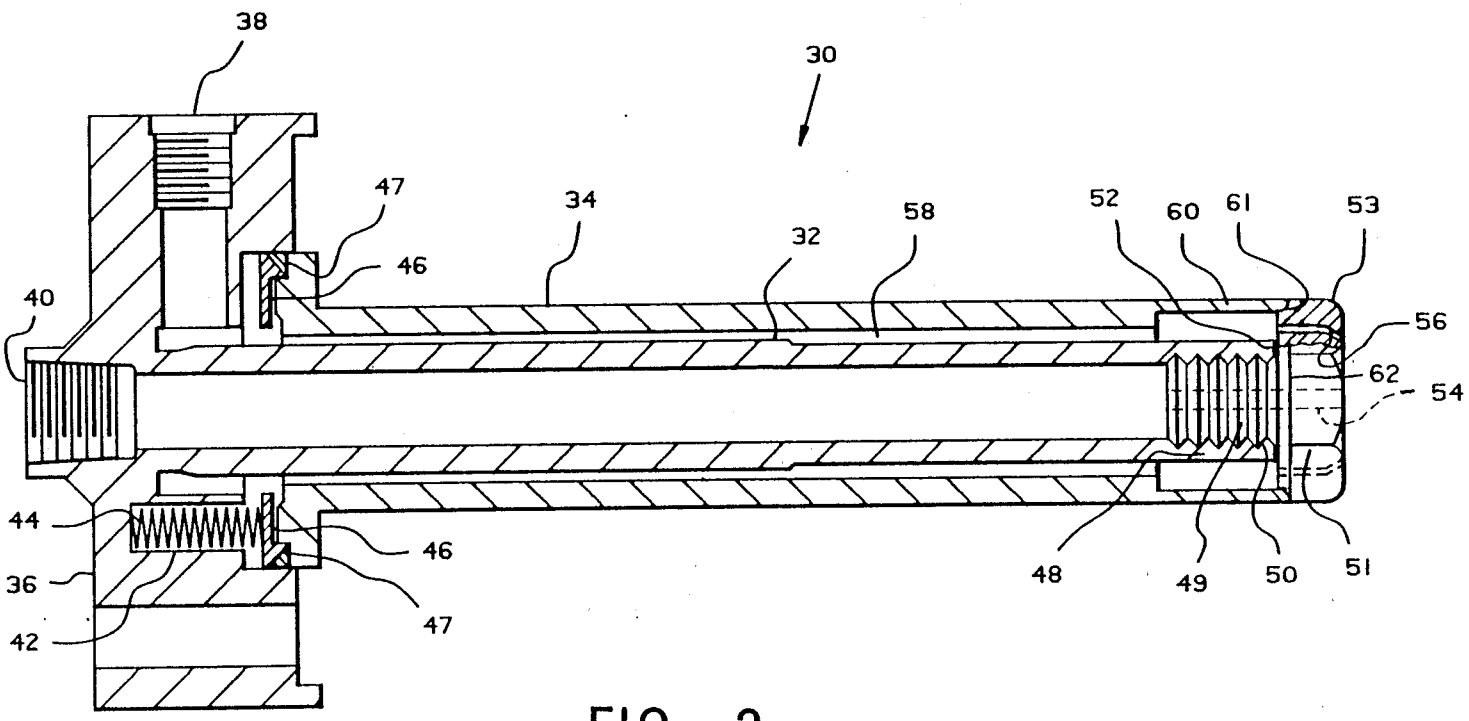
FIG. 2 is an axial cross-sectional view of the fuel nozzle assembly of the present invention.

Turning next to FIG. 2, the fuel nozzle assembly 30 of the present invention may be seen. The fuel nozzle assembly 30 includes an inner fuel delivery tube 32 and an outer air delivery tube 34 extending axially from a support flange 36 at one end. The air delivery tube 34 is concentric and substantially coextensive with the fuel delivery tube 32.

The fuel delivery tube 32 has an axial opening which is internally threaded at each end thereof. A fuel line (not shown) is normally received in the fuel inlet end 40. The delivery end 48 of the fuel delivery tube 32 terminates in engaging means such as an integral fuel nozzle/end cap 49 threaded onto the fuel delivery tube 32. The integral fuel nozzle/end cap 49 includes a threaded skirt portion 50 for attaching the integral fuel nozzle/end cap 49 to the delivery end 48, a flange 51 and an end cap portion 53 for engaging the end 60 of air delivery tube 34. A sealing washer 52 is interposed between the flange 51 and the threaded skirt portion 50 to prevent oil leaking from the fuel delivery tube. The end cap portion 53 is further provided with a central opening 54 in communication with the central opening of delivery end 48 for delivery of fuel from the fuel delivery tube 32. End cap portion 53 is further provided with small apertures 56 equilangularly spaced around central opening 54 in communication with annular air passage 58 for delivery of air from passage 58 through apertures 56 for directing atomizing air in a predetermined convergent direction to intercept and atomize the fuel exiting the central opening 54 of the integral fuel nozzle/end cap 49.

The air delivery tube 34 extends axially with, and concentric to, the fuel delivery tube 32 to define the annular air passage 58 between the outer wall of fuel delivery tube 34 and the inner wall of air delivery tube 34 throughout their common axial extent. The end 60 of air delivery tube 34 mates with end cap portion 53 of the integral fuel nozzle/end cap 49 in a manner to be described more fully later to provide the seal between air delivery tube 34 and fuel delivery tube 32.

The support flange 36, which mounts the fuel delivery tube on the gas turbine engine, extends radially outwardly from the fuel delivery tube 32. The support flange 36 has a threaded, radially extending atomizing air inlet 39 for receipt of an air line (not shown). The support flange also includes a spring receiving opening 42 for receipt of a biasing spring 44.

When mounting the air delivery tube 34 onto fuel delivery tube 32, biasing spring 44 compresses, exerting axial force onto beveled washer 46. In turn, beveled washer 46, acting through split piston ring 47, exerts axial pressure on air delivery tube 34. Integral fuel nozzle/end cap 49 is attached to fuel delivery tube 34 by screwing threaded skirt portion 50 of integral fuel nozzle/end cap 49 into the delivery end 48 of fuel delivery tube 34 until tight. Once the integral fuel nozzle/end cap is secured to the fuel delivery tube 32, the air delivery tube 34, under the influence of axial pressure from biasing spring 44, engages the end cap portion 53 of the integral fuel nozzle/end cap 49 in a tight fit. Thus, the fuel delivery tube 32 and air delivery tube 34 are sealed together such that leakage of atomizing air which adversely affects the atomization of fuel is unlikely.

Further, split piston ring 47, acting under pressure exerted by beveled washer 46, exerts radial pressure along its common circumference with support flange 36 to eliminate any gap between the support flange 36 and the air delivery tube 34. Thus, additional air leakage which would otherwise occur at the support flange 36/air delivery tube 34 interface is eliminated by the air-tight seal between support flange 36 and split piston ring 47.

Alignment of annular air passage 58 and apertures 56 is provided by a lip 62 of end cap portion 53. As the threaded portion 50 of integral fuel nozzle/end cap 49 is tightened onto fuel delivery tube 32, the protruding lip 62 of integral fuel nozzle/end cap 49 engages the protruding tip portion 61 of end 60. The engagement of protruding tip 61 and protruding lip 62 aligns the air delivery tube 34 and the integral fuel nozzle/end cap 49 in a desired orientation which simultaneously aligns annular air passage 58 and aperture 56 such that air flowing through air passage 58 is communicated to aperture 56.

When the fuel nozzle assembly 30 of the present invention is subjected to normal temperature conditions, i.e. when there is no extreme temperature differential between the fuel flowing in the fuel delivery tube 32 and air delivery tube 34, the fuel and air delivery tubes are sealed at the interface of the end portion 53 of the integral fuel nozzle/end cap 49 and end 60 of air delivery tube 34 interface. No gapping is present at the interface, and contamination of the air passage 58 is unlikely. The air atomization of the fuel spray generally results in the desired atomized nodular spray pattern.

When the fuel nozzle assembly of the present invention is subject to axial expansion of the air delivery tube caused by the extreme thermal conditions which arise during operation of the gas turbine engine, the air delivery tube 34 expands axially to a greater extent than the fuel delivery tube 32. As the air delivery tube 34 expands, the end 60 of air delivery tube 34 expands axially with respect to end cap portion 53. The sealing interface between end 60 and end cap portion 53 is tightened, thus improving the seal between the two to prevent the leakage of atomizing air. Continued axial expansion of the air delivery tube 34 will compress biasing spring 44 and will not cause separation of the seal between fuel delivery tube 32 and air delivery tube 34 as biasing spring 44 will accommodate axial expansion of the air delivery tube 34. The increased axial force due to compression of biasing spring 44 will also increase radial pressure of split piston ring 47 on support flange 36 to further decrease air leakage at the support flange 36/air delivery tube 34 interface by strengthening the air-tight seal between support flange 36 and split piston ring 47.

We claim as our invention:

1. A fuel nozzle assembly for a gas turbine engine comprising:

a fuel delivery tub having a delivery end and fuel inlet means at an opposite end;

a support flange attached to said fuel delivery tube generally adjacent said fuel inlet means;

an air delivery tube having an end, said air delivery tube substantially enclosing said fuel delivery tube, said air delivery tube extending axially from said support flange in spaced relation to said fuel delivery tube to define an annular air chamber between said tubes for delivery of air to said end of said air delivery tube;

engaging means comprising an integral fuel nozzle/end cap having a fuel nozzle portion and an end cap portion, said fuel nozzle portion attached to said delivery end of said fuel delivery tube and said end cap portion engaging the end of said air delivery tube, said end cap portion extending axially past said air delivery tube end and having a lip which engages said end, said lip and said end forming a seal positioned axially between said air delivery tube and said end cap portion.

2. Fuel nozzle assembly of claim 1 comprising biasing means for biasing the end of said air delivery tube into sealed engagement with said engaging means.

3. Fuel nozzle assembly of claim 1 wherein said engaging means further comprises a plurality of atomizing air apertures in communication with said annular air passage.

4. Fuel nozzle assembly of claim 3 wherein said engaging means further comprises means for aligning said atomizing air apertures and said annular air passage.

5. Fuel nozzle assembly of claim 3 wherein said end of said air delivery tube further comprises a protruding tip for engaging said lip of said engaging means, said engagement of said protruding tip and said protruding lip aligning said plurality of atomizing air apertures and said annular air chamber.

6. Fuel nozzle assembly of claim 1 wherein said end of said air delivery tube further comprises a protruding tip for engaging said lip of said engaging means.

7. Fuel nozzle assembly of claim 1 further comprising means for providing an air tight seal between said air delivery tube and said support flange.

8. Fuel nozzle assembly of claim 7 wherein said means for providing an airtight seal between said air delivery tube and said support flange further comprises:

a split piston ring adjacent said air delivery tube; and biasing means for biasing said split piston ring into sealed engagement with said support flange.

9. In a fuel nozzle assembly of a gas turbine, said assembly having a fuel delivery tube having a delivery end and a fuel inlet end, an air delivery tube having an end, said air delivery tube substantially enclosing said fuel delivery tube to define an annular air passage between said tubes for delivery of air to said end of said air delivery tube, and engaging means for engaging said air delivery tube and said fuel delivery tube, the improvement comprising:

said engaging means comprising an integral fuel nozzle/end cap having a fuel nozzle portion and an end cap portion, said fuel nozzle portion being attached to said fuel delivery tube at said delivery end and said end cap portion engaging the end of said air delivery tube, said engaging means having an interior opening for delivery of fuel from said fuel delivery tube and atomizing air apertures for delivery of air from said annular air passage, and said end cap portion extending axially past said air delivery tube end and having a lip which engages said end, said lip and said end forming a seal positioned axially between said air delivery tube and said end cap portion.

10. Fuel nozzle assembly of claim 9 comprising biasing means for biasing the end of said air delivery tube into sealed engagement with said engaging means.

11. Fuel nozzle assembly of claim 9 wherein said engaging means further includes means for aligning said annular air passage and said atomizing air aperture.

12. Fuel nozzle assembly of claim 9 further comprising a support flange for supporting said fuel nozzle assembly in said gas turbine engine, said support flange further supporting said air delivery tube; and means for providing an air-tight seal between said air delivery tube and said support flange.

13. Fuel nozzle assembly of claim 12 wherein said means for providing an air-tight seal between said air delivery tube and said support flange further comprises a split piston ring adjacent said air delivery tube; and biasing means for biasing said split piston ring into sealed engagement with said support flange.

14. In a gas turbine engine of the type having air supplied to a combustion chamber at a high temperature and fuel supplied to said combustion chamber at a relatively low temperature, a fuel nozzle assembly comprising a fuel delivery tube having a delivery end and fuel inlet means at an opposite end, a support flange attached to said fuel delivery tube generally adjacent said fuel inlet means, an air delivery tube having an end, said air delivery tube substantially enclosing said fuel delivery tube, said air delivery tube extending axially forward from said support flange in spaced relation to said fuel delivery tube to define an annular air chamber between said tubes for delivery of air to said end of said air delivery tube, engaging means comprising an integral fuel nozzle/end cap having a fuel nozzle portion and an end cap portion, said fuel nozzle portion attached to said fuel delivery tube and said end cap portion being position axially forward of and engaging the end of said air delivery tube, and means for sealing said engagement of the end of said air delivery tube and said engaging means.

15. Fuel nozzle assembly of claim 14 wherein said integral fuel nozzle/end cap further comprises a plurality of atomizing air apertures in communication with said annular air passage.

16. Fuel nozzle assembly of claim 15 wherein said air delivery tube further comprises a protruding tip for engaging said lip of said end cap portion, said engagement of said protruding tip and said protruding lip aligning said plurality of atomizing air apertures and said annular air chamber.

* * * * *